US010361480B2

(12) United States Patent
Harper

(10) Patent No.: US 10,361,480 B2
(45) Date of Patent: Jul. 23, 2019

(54) ANTENNA ISOLATION USING A TUNED GROUNDPLANE NOTCH

(71) Applicant: Microsoft Technology Licensing, LLC, Redmond, WA (US)

(72) Inventor: Marc Harper, Issaquah, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 263 days.

(21) Appl. No.: 14/610,898

(22) Filed: Jan. 30, 2015

(65) Prior Publication Data

US 2015/0138036 A1 May 21, 2015

Related U.S. Application Data

(63) Continuation of application No. 14/481,699, filed as application No. PCT/GB2013/005067 on Mar. 7, 2013.

(30) Foreign Application Priority Data

Mar. 13, 2012 (GB) ..... 1204373.3

(51) Int. Cl.
*H01Q 1/52* (2006.01)
*H01Q 1/48* (2006.01)

(52) U.S. Cl.
CPC ..... *H01Q 1/48* (2013.01); *H01Q 1/521* (2013.01); *Y10T 29/49018* (2015.01)

(58) Field of Classification Search
CPC ..... H01Q 1/52; H01Q 1/521; H01Q 1/523; H01Q 5/00; H01Q 1/241–1/243;
(Continued)

(56) References Cited

U.S. PATENT DOCUMENTS 4,876,552 A * 10/1989 Zakman ..... H01Q 1/243 343/702
6,297,711 B1 * 10/2001 Seward ..... H01Q 1/3266 333/129

(Continued)

FOREIGN PATENT DOCUMENTS

CN 201289902 * 1/2006
CN 201289902 A1 8/2009

(Continued)

OTHER PUBLICATIONS

Kim, et al., "The High Isolation Dual-Band Inverted F Antenna Diversity System with the Small N-Section Resonators on the Ground Plane," Asia-Pacific Microwave Conference, 2006, Copyright 2006 IEICE, 5 pages.

(Continued)

*Primary Examiner* — Jessica Han
*Assistant Examiner* — Awat M Salih
(74) *Attorney, Agent, or Firm* — Holzer Patel Drennan

(57) ABSTRACT

There is disclosed an antenna device relating to a single or dual band antenna system for use in mobile telecommunications devices, laptop and tablet computers, USB adapters and electrically small radio platforms comprising a pair of antennas attached to a conductive ground plane, the antennas being separated by free space in which at least one notch is formed in the conductive ground plane between the pair of antennas characterized in that the notch further includes an inductive component and a capacitive component providing good antenna isolation so as to enable MIMO operation or diversity operation.

22 Claims, 10 Drawing Sheets

(58) Field of Classification Search
CPC ..... H01Q 1/148; H01Q 9/0421; H01Q 1/48; H01Q 1/38; H01Q 1/526; H01Q 21/28; H01Q 5/371
USPC ..... 343/841, 893, 848
See application file for complete search history.

(56) References Cited

U.S. PATENT DOCUMENTS 6,624,789 B1 * 9/2003 Kangasvieri ..... H01Q 1/243 343/702
6,909,911 B2 * 6/2005 Boyle ..... H01Q 1/243 343/702
7,298,339 B1 * 11/2007 Ollikainen ..... H01Q 1/243 343/700 MS
7,764,233 B2 * 7/2010 Wu ..... H01Q 1/243 343/700 MS
7,872,608 B2 * 1/2011 Li ..... H01Q 1/2291 343/700 MS
8,462,072 B2 * 6/2013 Andrenko ..... H01Q 1/38 343/700 MS
8,581,799 B2 * 11/2013 Choi ..... H01Q 1/243 343/845
8,648,763 B2 * 2/2014 Choi ..... H01Q 1/48 343/845
2003/0038750 A1 * 2/2003 Chen ..... H01Q 1/242 343/700 MS
2003/0112198 A1 * 6/2003 Wang ..... H01Q 1/243 343/770
2003/0160728 A1 * 8/2003 Fukushima ..... H01Q 1/242 343/702
2003/0193437 A1 10/2003 Kangasvieri et al.
2003/0201944 A1 * 10/2003 Aikawa ..... H01Q 21/064 343/770
2004/0227683 A1 * 11/2004 Caimi ..... H01Q 1/36 343/742
2006/0061509 A1 * 3/2006 Chen ..... H01Q 1/243 343/700 MS
2006/0097918 A1 * 5/2006 Oshiyama ..... H01Q 1/243 343/700 MS
2006/0109175 A1 * 5/2006 Yeh ..... H01Q 1/38 343/700 MS
2006/0132365 A1 * 6/2006 Chou ..... H01Q 1/243 343/702
2006/0181448 A1 * 8/2006 Natsume ..... G01S 7/36 342/70
2006/0181468 A1 8/2006 Iguchi et al.
2007/0001811 A1 1/2007 Fujio et al.
2007/0001911 A1 * 1/2007 Fujio ..... H01Q 9/0407 343/700 MS
2008/0266189 A1 * 10/2008 Wu ..... H01Q 1/22 343/702
2008/0278384 A1 * 11/2008 Shimasaki ..... H01Q 1/2266 343/702
2009/0091507 A1 4/2009 Chung et al.
2009/0128439 A1 * 5/2009 Su ..... H01Q 1/243 343/795
2010/0066621 A1 * 3/2010 Chang ..... H01Q 9/40 343/767
2010/0073247 A1 * 3/2010 Arkko ..... H01Q 1/243 343/745
2010/0238079 A1 * 9/2010 Ayatollahi ..... H01Q 1/243 343/729
2011/0187615 A1 8/2011 Sakata et al.
2011/0210898 A1 9/2011 Choi et al.
2011/0234463 A1 9/2011 Lankes et al.
2011/0237207 A1 * 9/2011 Bauder ..... H01Q 1/521 455/78
2012/0026061 A1 * 2/2012 Shachar ..... H01P 5/10 343/859
2012/0028685 A1 * 2/2012 Van Wonterghem ..... H01Q 1/243 455/566
2012/0274522 A1 * 11/2012 Ayatollahi ..... H01Q 1/243 343/745
2013/0069837 A1 * 3/2013 Cozzolino ..... H01Q 13/10 343/727
2013/0115884 A1 * 5/2013 Zhang ..... H01Q 1/243 455/41.2
2013/0135155 A1 * 5/2013 Zhang ..... H01Q 1/243 343/700 MS
2013/0222186 A1 8/2013 Leung et al.

FOREIGN PATENT DOCUMENTS

| | | | | |
|---|---|---|---|---|
| CN | 101577364 | A | | 11/2009 |
| CN | 101872897 | A | | 10/2010 |
| CN | 102187519 | A | | 9/2011 |
| EP | 2230717 | A1 | | 9/2010 |
| EP | 2161785 | A1 | | 10/2010 |
| EP | 2326018 | A1 | | 5/2011 |
| EP | 2363914 | A1 | | 7/2011 |
| EP | 2360782 | A2 | | 8/2011 |
| EP | 2387191 | A1 | | 11/2011 |
| GB | 2401994 | | * | 11/2004 |
| GB | 2401994 | A | | 11/2004 |
| JP | 2007243455 | | * | 7/2006 |
| JP | 2007243455 | A | | 9/2007 |
| JP | 20077243455 | | * | 9/2007 |
| WO | 2006097496 | A1 | | 9/2006 |
| WO | 2011087177 | A1 | | 7/2011 |
| WO | 2013136050 | A1 | | 9/2013 |

OTHER PUBLICATIONS

International Searching Authority, U.S. Patent and Trademark Office, International Search Report for PCT/GB2013/050567, dated Jun. 27, 2013, 3 pages.
"Second Office Action Issued in Chinese Application No. 201380013829.9", dated Jan. 18, 2016, 7 Pages.
"Office Action Issued in United Kingdom Application No. 1204373.3", dated Nov. 27, 2015, 2 Pages.
"First Office Action and Search Report Issued in Chinese Application No. 201380013829.9", dated Jun. 24, 2015, 13 Pages.
"Office Action Issued in United Kingdom Patent Application No. 1204373.3", dated Feb. 2, 2015, 4 Pages.
"Office Action and Search Report Issued in Taiwan Patent Application No. 102108462", dated Dec. 8, 2016, 9 Pages.
"Non-Final Office Action Issued in U.S. Appl. No. 14/481,699", dated Nov. 4, 2016, 25 Pages.
"Final Office Action Issued in U.S. Appl. No. 14/481,699", dated May 3, 2017, 23 Pages.
"Office Action Issued in Taiwan Patent Application No. 106114202", dated Jan. 23, 2018, 4 Pages.
"Final Office Action Issued in U.S. Appl. No. 14/481,699", dated Mar. 21, 2018, 31 Pages.
"Non-Final Office Action Issued in U.S. Appl. No. 14/481,699", dated Sep. 27, 2017, 22 Pages.
"Notice of allowance issued in Taiwan Application No. 102108462", dated Mar. 28, 2017, 4 Pages.
"Notice of Allowance Issued in Taiwanese Patent Application No. 106114202", dated May 22, 2018, 4 Pages.
"Notice of Allowance Issued in United Kingdom Patent Application No. 1204373.3", dated Apr. 19, 2016, 2 Pages.
"Office Action Issued in European Patent Application No. 13709261.5", dated Apr. 6 2018, 9 Pages.
"Notice of Allowance Issued in Chinese Patent Application No. 201380013829.9", dated Jun. 6, 2016, 4 Pages.

* cited by examiner

| MARKERS: | MHz | dB | MHz | dB |
|---|---|---|---|---|
| Single Band Isolation | | | | |
| ——— | 1: 2400 | -10.49 | 3:5200 | -5.50 |
| | 2: 2500 | -23.42 | 4:5800 | -16.93 |
| No Isolation | | | | |
| ——— | 1: 2400 | -8.32 | 3:5200 | -5.93 |
| | 2: 2500 | -10.01 | 4:5800 | -18.45 |

| MARKERS: | MHz | dB | MHz | dB |
|---|---|---|---|---|
| No Isolation | | | | |
| ——— | 1: 2400 | -8.32 | 3: 5200 | -5.93 |
| | 2: 2500 | -10.01 | 4: 5800 | -18.45 |
| Dualband Isolation | | | | |
| ——— | 1: 2400 | -14.19 | 3: 5200 | -21.31 |
| | 2: 2500 | -26.93 | 4: 5800 | -16.50 |

ANTENNA ISOLATION USING A TUNED GROUNDPLANE NOTCH

The present application is a continuation of and claims benefit of U.S. 371 National Phase patent application Ser. No. 14/481,699, entitled "Antenna Isolation Using a Tuned Goundplane Notch" and filed 9 Sep. 2014, which claims benefit of Patent Cooperation Treaty Application No. PCT/GB2013/050567, entitled "Antenna Isolation Using a Tuned Groundplane Notch" and filed on 7 Mar. 2013, which takes priority from U.K. Patent Application No. 1204373.3, entitled "Antenna Isolation using a Tuned Groundplane Notch" and filed on 13 Mar. 2012, all of which are incorporated herein by reference in their entirety.

Embodiments of the present invention relate to a single or dual band antenna designed in such a way as to provide improved antenna isolation for two or more antennas operating on similar frequencies in close proximity to each other for use in mobile telephone handsets, laptop and tablet computers, USB adaptors and other electrically small radio platforms. In particular, embodiments of the present invention provide a high degree of isolation even when the antennas are disposed electrically close to one another, as on a typical portable device, thereby enabling the use of multiple antennas at both ends of a radio link in order to improve signal quality and to provide high data transmission rates through the use of MIMO operation or antenna diversity.

BACKGROUND

Different types of wireless mobile communication devices such as mobile telephone handsets, laptop and tablet computers, USB adaptors and other electrically small radio platforms are available. Such devices are intended to be compact and therefore are easily carried on one's person.

There exists a need to increase system capacity while still maintaining compact devices. One method for improving signal quality and data transmission rates is MIMO (multiple-input and multiple-output). MIMO is the use of multiple antennas at both the transmitter and receiver to improve data capacity and performance for communication systems without additional bandwidth or increased transmit power. Similarly, antenna diversity (often just at the receiving end of a radio link) improves signal quality by switching between two or more antennas, or by optimally combining the signals of multiple antennas.

However, antennas in close proximity to each other are prone to performance degradation due to electromagnetic interference. Therefore, it is desirable to develop devices designed to isolate the antennas and minimize any performance degradation.

For effective operation, both MIMO and diversity techniques require a degree of isolation between adjacent antennas that is greater than is normally available when the antennas are disposed electrically close to one another, as on a typical portable device.

CN201289902 (Cybertan) describes a structure in which two antennas are disposed such that one antenna is arranged on each side of a grounding surface and connected with the grounding surface through a feed-in point. The isolation between the antennas is improved by perforating the grounding surface with an isolating slotted hole between the first antenna and the second antenna. CN201289902 does not, however, disclose the arrangement of a slot or notch in the edge of the grounding surface, or the tuning of such a notch.

GB2401994 (Antenova) discloses how the isolation between two similar antennas may be improved by forming at least one slot, cut, notch or discontinuity in the edge of a conductive ground plane in a region between the feed lines of the two antennas.

U.S. Pat. No. 6,624,789 (Nokia) discloses that the isolation is improved if the length of the cut is substantially equal to one quarter-wavelength of the operating frequency band.

EP2387101 (Research In Motion) further discloses how a slot in a conductive ground plane may be meandered or bifurcated.

None of these patents describe the tuning of a slot or notch although U.S. Pat. No. 6,624,789 does show how placing a switch across the slot may be used to change the effective slot length.

All of the references identified above are hereby incorporated into the present application by way of reference, and are thus to be considered as part of the present disclosure.

BRIEF SUMMARY OF THE DISCLOSURE

In a first aspect of the present invention there is provided an antenna device comprising a substrate including a conductive groundplane, the conductive groundplane having an edge, and at least first and second antennas connected to the edge of the conductive groundplane, wherein which at least one notch is formed in the edge of the conductive ground plane between the first and second antennas, the notch having a mouth portion at the edge of the conductive groundplane, and wherein the mouth of the notch is provided with at least one capacitive component that serves to tune an inductance of the edge of the conductive groundplane in the notch so as to improve isolation between the first and second antennas.

The notch may take the form of a generally re-entrant cut-out in the edge of the conductive groundplane. The notch may be substantially rectangular, having substantially parallel sides or edges.

In some embodiments, the capacitive component may be formed as a conductive strip that extends across the mouth and includes at least one capacitor. The conductive strip will have an inductance in series with the at least one capacitor, and can be considered to be a parallel inductance to the inductance of the edge of the conductive groundplane in the notch.

In a preferred embodiment of the present invention, an inductive component and a capacitive component together form a tuneable resonant circuit parallel to an inductive path defined along the edge of the notch in the edge of the conductive groundplane. It will be appreciated that the parallel resonant circuit results in a change in the electrical path length between the antennas and the ground plane. The resonant circuit may be adjusted so as to cause some cancellation of mutual coupling currents flowing along the edge of the groundplane. This can significantly improve the isolation between the antennas without causing a severe loss of efficiency. Increasing the spacing between the first and second antennas may improve the isolation in a progressive manner.

In some embodiments of the present invention, the antennas may be disposed substantially parallel to each other. However, in yet further embodiments of the present invention a pair of antennas may be oriented at substantially 90 degrees with respect to each other or oriented at orientation angles other than 90 degrees with respect to each other.

The first and second antennas may be configured as monopoles, planar inverted F antennas (PIFAs), parasitically driven antennas, loop antennas or various dielectric antennas such as dielectrically loaded antennas (DLAs), dielectric resonator antennas (DRAs) or high dielectric antennas (HDAs). First and second antennas may also be different from each other. Different antennas may require a different tuning capacitor value compared with the value for two identical antennas because the phase of the resonant frequency current on the edge of the groundplane may be different.

In some embodiments of the present invention the distance (D) between the antennas may be around ⅕ wavelength, for example when a pair of 2.4 GHz antennas are used.

In further embodiments of the present invention the notch is formed as a gap or cut-out in the ground plane and extends by a predetermined width along the ground plane edge (w) and a predetermined depth (d) into the ground plane.

It has been found that if the distance around the edge of the notch is kept constant as the aspect ratio of the notch is varied (from square to elongate), the isolation does not change significantly. However, if the notch is very elongate, then the bandwidth of the isolation effect becomes narrower. The performance for deep, narrow notches or slots is poorer than for notches or slots with a squarer aspect ratio.

The edge of the conductive groundplane need not, in all embodiments, follow a straight line. For example, the edge of the conductive groundplane may have an inverted "V" shape, with one antenna on either side of the generally triangular groundplane, which is provided with a notch as previously discussed.

In further embodiments of the present invention, the resonant frequency of the isolating effect is determined by the inductance along the edge of the notch and the capacitance of a capacitive component provided in or across the notch.

The resonant frequency of the isolating effect may be changed by changing the value of the capacitive component.

Alternatively or in addition, the resonant frequency of the isolating effect may be changed by the addition of one of more capacitive stubs in the notch. This arrangement may increase the bandwidth of the isolation effect.

In further embodiments of the present invention the resonant frequency of the isolating effect may be tuned or changed by the addition of inductive components in the notch.

Indeed, in all embodiments of the present invention, the notch may include additional inductive components and/or additional capacitive components.

In some embodiments, a single capacitor is provided at one edge of the notch.

In other embodiments, two capacitive components are provided, one at each edge of the notch, the capacitive components being connected by a conductive strip. The conductive strip may optionally be grounded near the center between the two capacitive components. The use of two capacitors in place of a single capacitor increases cost, but has the advantage of somewhat greater efficiency while maintaining a similar bandwidth as the single capacitor solution.

In further embodiments of the present invention, first and second notches or slots are provided at the edge of the groundplane, the first notch being tuned to a lower frequency band (e.g. 2.4 GHz) and the second notch being tuned to a higher frequency band (e.g. 5 GHz). Such embodiments can provide good isolation and antenna efficiency in the higher band.

In further embodiments of the present invention a groundplane extension is provided between the first and second antennas and a tuneable notch provided within the groundplane extension.

In further embodiments, an extended conductive strip or loop may be provided across the notch so as to increase the self-inductance of the notch.

In a yet further embodiment, there is provided a substantially linear array of antennas disposed along an edge of conductive groundplane, with a tuned notch isolation arrangement between each pair of neighboring antennas, the overall configuration taking the general pattern of antenna-slot-antenna-slot-antenna-slot-antenna-etc.

In one embodiment, the first and second antennas may be resonant parasitic antennas each driven by an associated monopole.

Dual-band isolation may be achieved in certain embodiments by providing an additional electrical pathway across the notch, parallel to the capacitive component provided across the mouth of the notch, and having a reactance. The additional pathway may comprise a resonant series circuit, for example a capacitor in series with an inductor, connecting one side edge of the notch to the opposed side edge of the notch in parallel to the at least one capacitor provided across the mouth of the notch. When the first and second antennas are interacting at a frequency that is not at the center frequency of the resonant series circuit, the resonant series circuit will present a high impedance and the current induced by the antennas will flow along the edge of the notch. A first frequency can be isolated by this mechanism by the at least one capacitive component provided across the mouth of the notch. When the first and second antennas are interacting at a frequency that is at or close to the center frequency of the resonant series circuit, then the resonant series circuit will present a low impedance and the current induced by the antennas will flow along the additional pathway through the resonant series circuit, this being shorter than the path around the edge of the notch. A second frequency can then be isolated by a combination of the capacitive component in the mouth of the notch and the resonant series circuit.

It is also possible to adjust the second isolation frequency by moving the additional pathway closer to or further from the mouth of the notch. Moving the additional pathway further away from the mouth (closer to the bottom of the notch) will generally lower the isolation frequency.

BRIEF DESCRIPTION OF THE DRAWINGS

Embodiments of the invention are further described hereinafter with reference to the accompanying drawings, in which.

DETAILED DESCRIPTION

Figure 1:
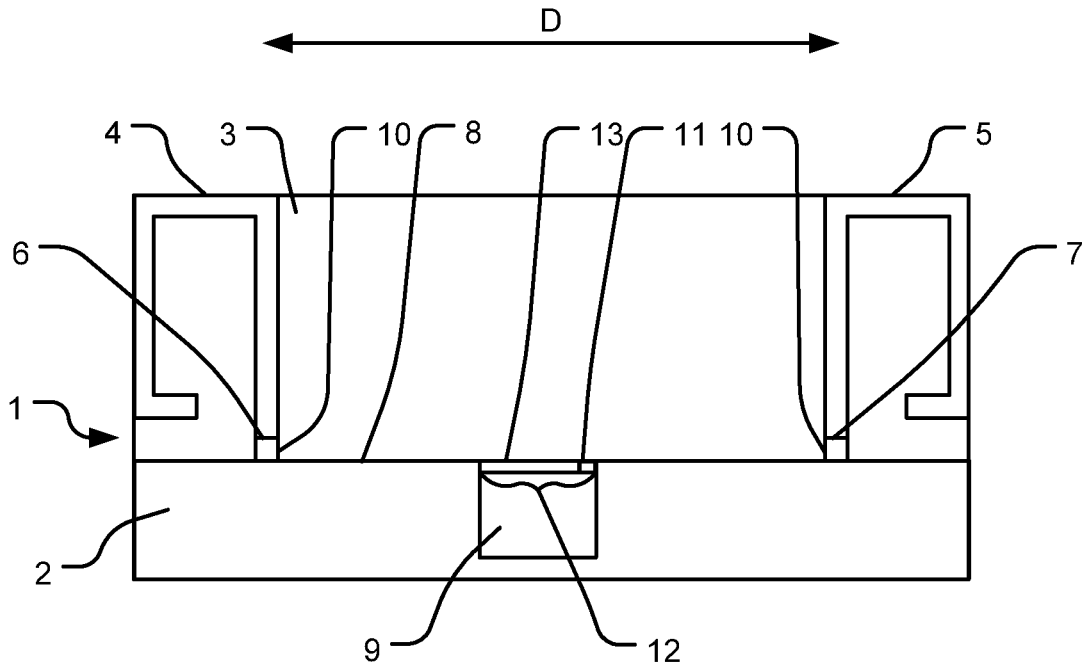
FIG. 1 shows a first embodiment of the present invention.
Figure 2:
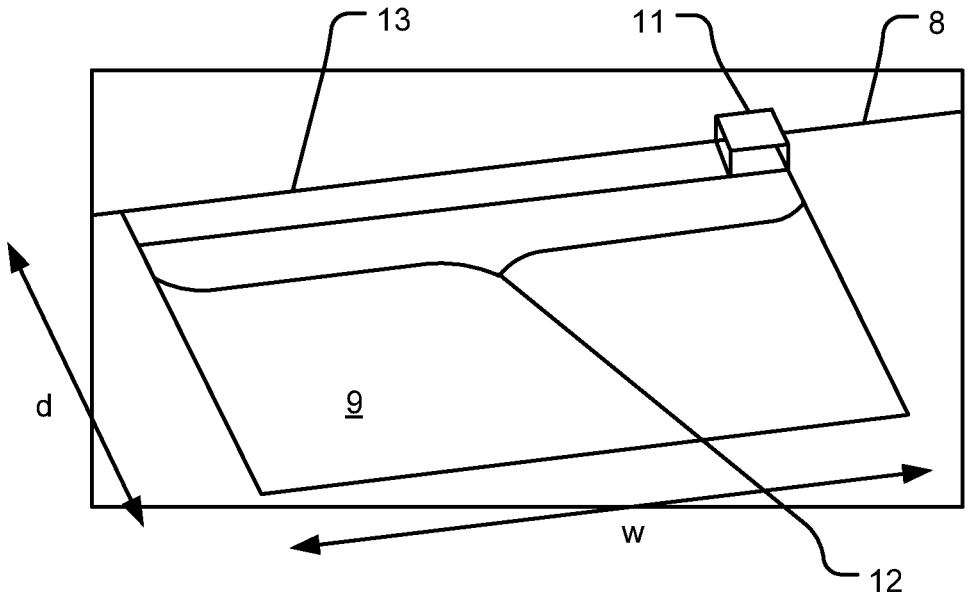
FIG. 2 shows a close up of the notch of FIG. 1.

FIG. 1 shows a first embodiment, comprising a dielectric substrate 1 having a conductive groundplane 2 and a groundplane-free end area 3. The groundplane 2 has an edge 8, which in this embodiment follows a substantially straight line across the substrate 1. First and second 2.4 GHz antennas 4, 5 are formed on the groundplane-free end area 3 of the substrate 1 with ends 6, 7 of the antennas 4, 5 provided with feeds 10 and connected to the edge 8 of the groundplane 2 by standard methods appropriate to the particular type of antenna in question. The antennas 4, 5 are disposed generally parallel to each other. The antennas 4, 5 may be spaced from each other by a distance D of around ⅕ wavelengths. At this close spacing the isolation between the antennas 4, 5 is poor at around −5 dB and is insufficient for effective multiple-input and multiple-output (MIMO) operation or diversity operation. MIMO or diversity operation is desirable because it can improve signal quality and data transmission rates. However, MIMO and diversity techniques require a degree of isolation between adjacent antennas 4, 5 that is greater than normally available when the antennas are disposed electrically close to one another as on a small portable device. The addition of a small notch 9 in the groundplane, in the area between the two antennas, does not in itself improve the isolation between the antennas significantly. This is because a small notch 9 does not make a significant change in the electrical path length between the antennas 4, 5 along the edge 8 of the groundplane 2. However, the present Applicant has surprisingly found that an inductive path round the notch 9 may be tuned by a capacitive component 11 disposed in a mouth 12 of the notch 9, thus forming a resonant circuit. The resonant circuit may further be adjusted so as to cause some cancellation of the mutual coupling currents flowing along the groundplane 2. This improves the isolation between the antennas 4, 5 significantly without creating a severe loss of antenna efficiency. Typically the isolation is better than −15 dB and the efficiency is better than 55%. This tuned notch arrangement is shown in the central area of FIG. 1 and in further detail in FIG. 2.

The notch 9 is formed as a gap or cut-out in the edge 8 of the groundplane 2 and extends by a predetermined width along the ground plane edge (w) and a predetermined depth (d) into the groundplane 2. If the distance around the edge of the notch 9 (i.e. 2d+w) is kept constant as the aspect ratio of the notch 9 is varied (for example from square to elongate), the isolation between the antennas 4, 5 is substantially unchanged. However, as the depth (d) of the notch 9 becomes large with the width (w) being kept relatively small, resulting in an elongated notch 9, the bandwidth of the isolation effect becomes narrower. Furthermore, the isolation performance and efficiency for a deep, narrow notch 9 is poorer.

Figure 3:
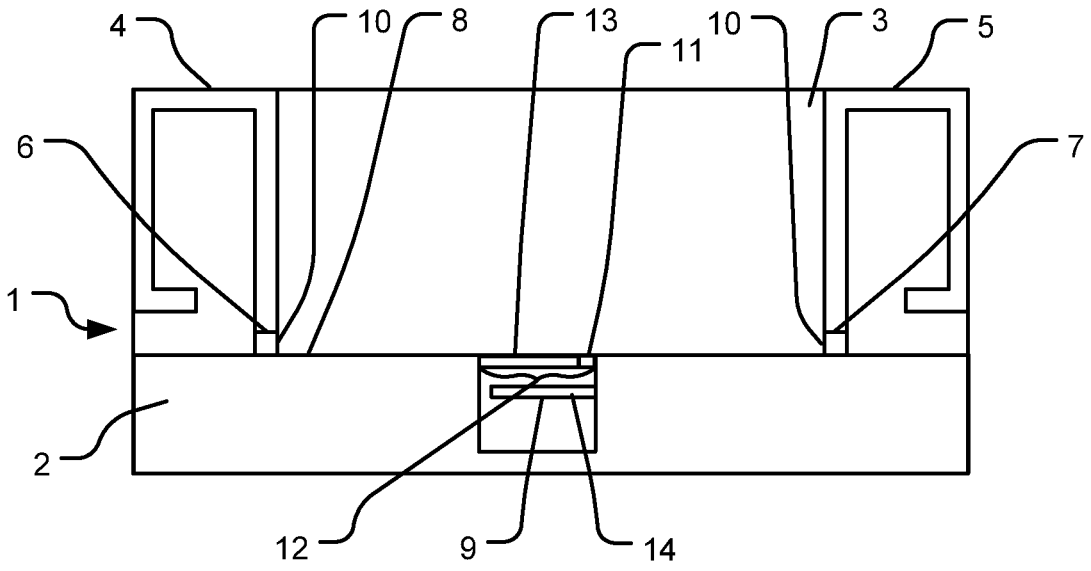
FIG. 3 shows the use of a capacitive stub in the slot to tune the antenna isolation.

The resonant frequency of the isolating effect is determined by the inductance round the edge of the notch 9 and the value of a capacitive component 11. The capacitive component 11 in this embodiment comprises a conductive strip 13, which itself has an inductance, connected in series with a capacitor 11 and disposed across the mouth 12 of the notch 9. The resonant frequency may also be altered by changing the value of the capacitive component 11, by using a variable capacitor such as a varactor diode, or alternatively through the addition of one or more capacitive stubs 14 in the notch 9, as shown in FIG. 3. This arrangement increases the bandwidth of the isolation effect. The resonant frequency may also be tuned through the addition of further inductive components.

Figure 4:
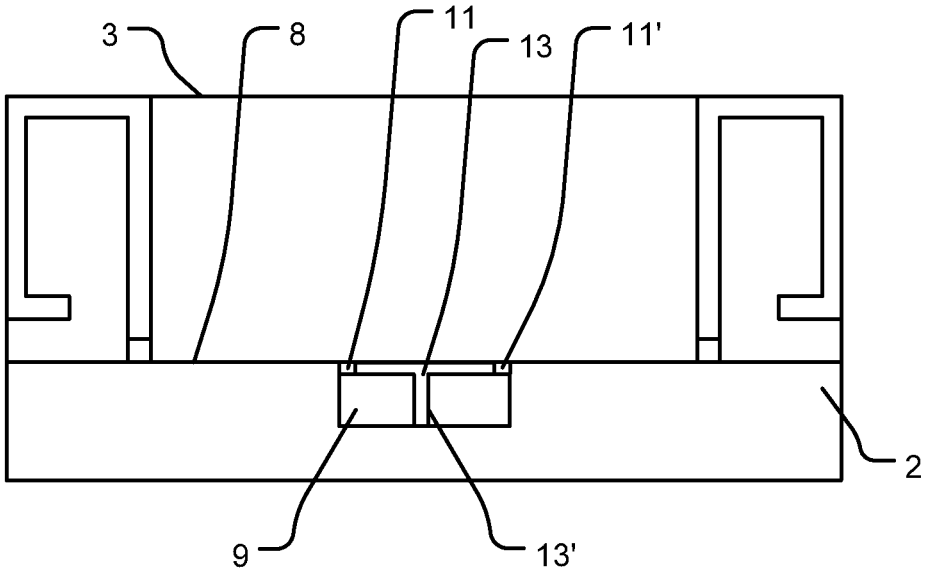
FIG. 4 shows the use of two capacitors and central grounding.

FIG. 4 shows an embodiment in which two capacitors 11, 11' are used, one at each edge of the notch 9. A conductive strip 13 is provided across the mouth 12 to connect the capacitors 11, 11', the conductive strip 13 being grounded near its centre between the two capacitors 11, 11' by way of a connection 13' to the groundplane 2. Although this embodiment requires two capacitive components and therefore increases cost, the advantage of improved efficiency whilst maintaining a similar bandwidth as compared with the single capacitor embodiment may be desirable for some applications.

Figure 5:
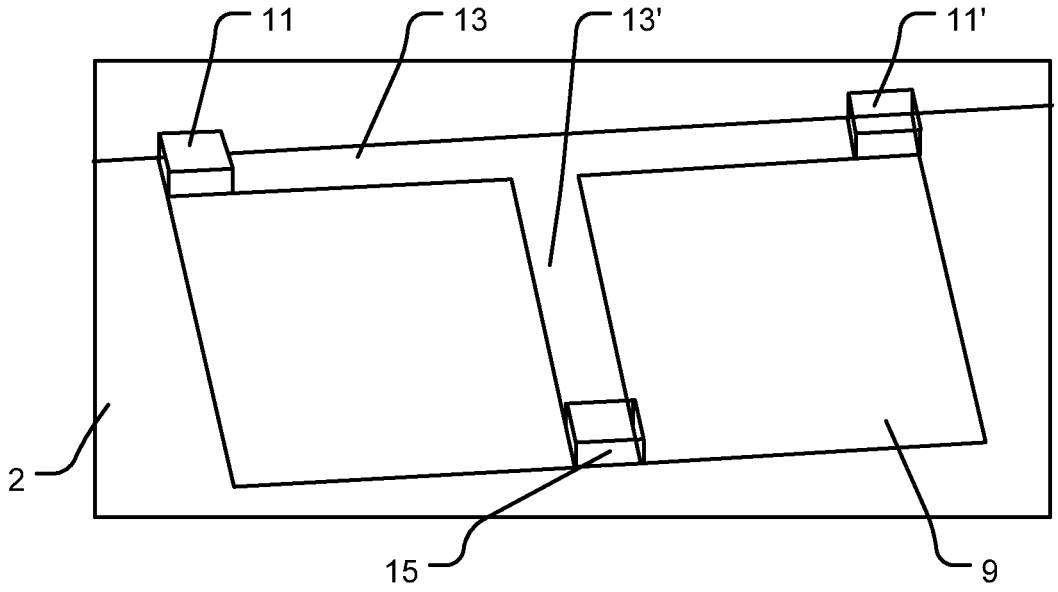
FIG. 5 shows a close up of the notch of FIG. 4 with an additional inductor.

It is possible to conceive more complex notch designs involving distributed components (such as the capacitive stub 14 shown in FIG. 3) or using real 'lumped' components that are soldered in place. Adding more such components increases the number of poles in the filter and enables better performance such as broader bandwidth, deeper nulling, or dual banding. A possible complex notch design is shown in FIG. 5. Two capacitors 11, 11' and an inductor 15 are arranged in the notch 9, connected by way of conductive strips 13, 13'.

Figure 6:
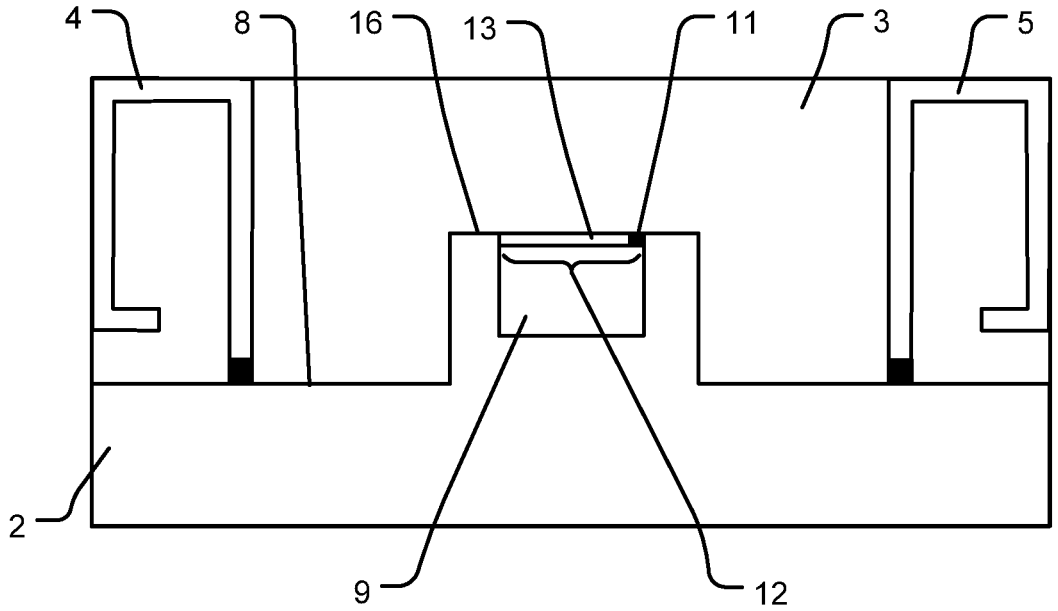
FIG. 6 shows the use a groundplane extension and tune slot.

FIG. 6 shows an antenna device where a groundplane extension 16 is provided between the antennas 4, 5 and used to house the slot or notch 9. In such an embodiment, isolation is improved by tuning the slot or notch 9 with a capacitor 11 and conductive strip 13 connected across the mouth 12 of the slot or notch 9 as described in connection with the previous embodiments.

Figure 7:
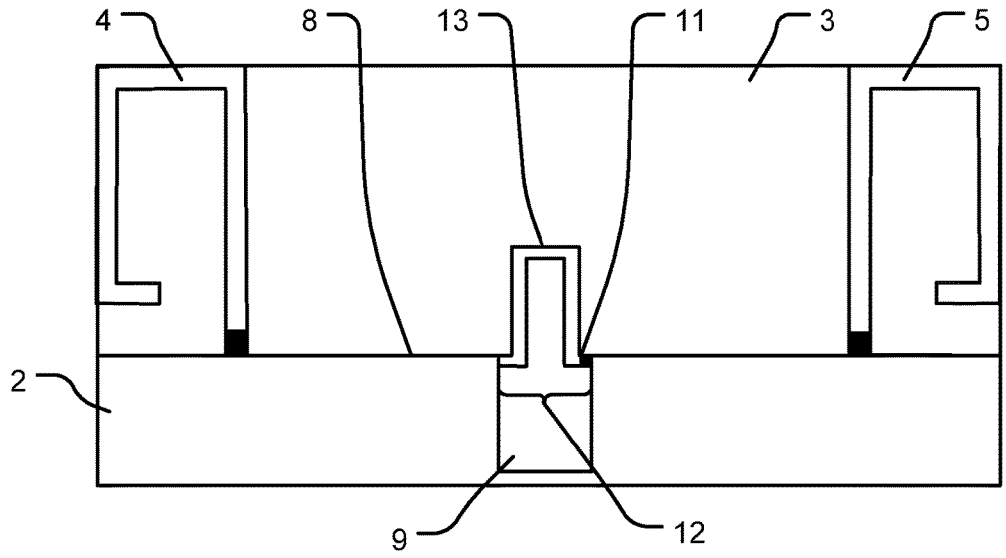
FIG. 7 shows an extended conductive strip.

FIG. 7 shows an antenna device in which the notch 9 includes an extended conductive strip 13 projecting out of the mouth 12 of the notch 9. This is used to increase the self-inductance of the notch 9. A capacitor 11 is provided at one end of the conductive strip 13.

Figure 8:
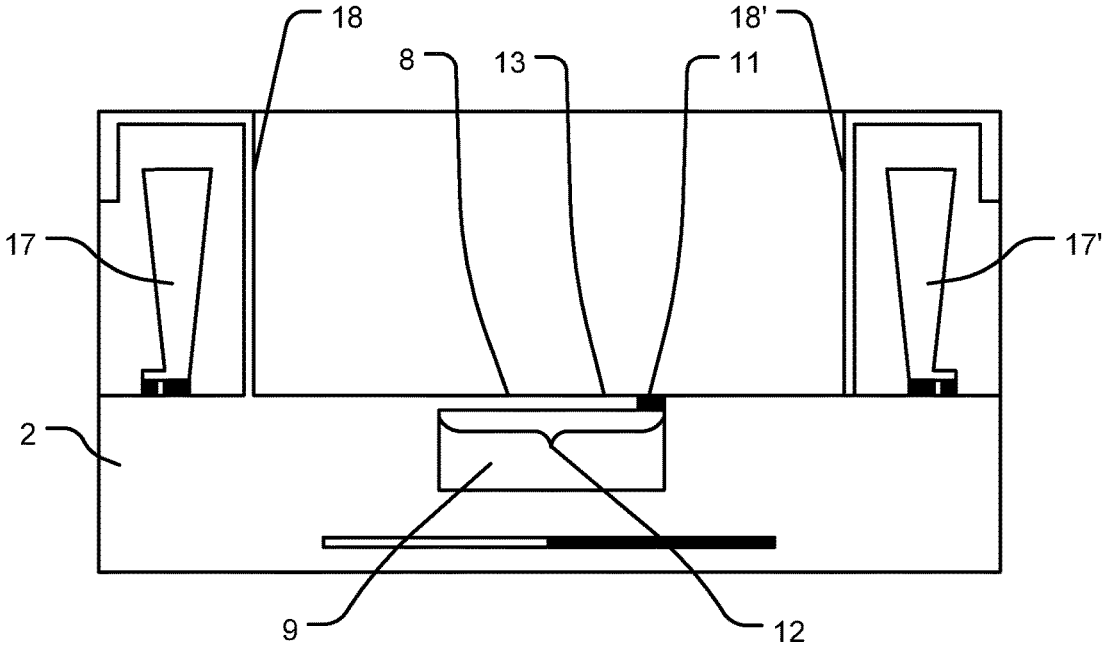
FIG. 8 shows how isolation may be improved between parasitic antennas.
Figure 9:
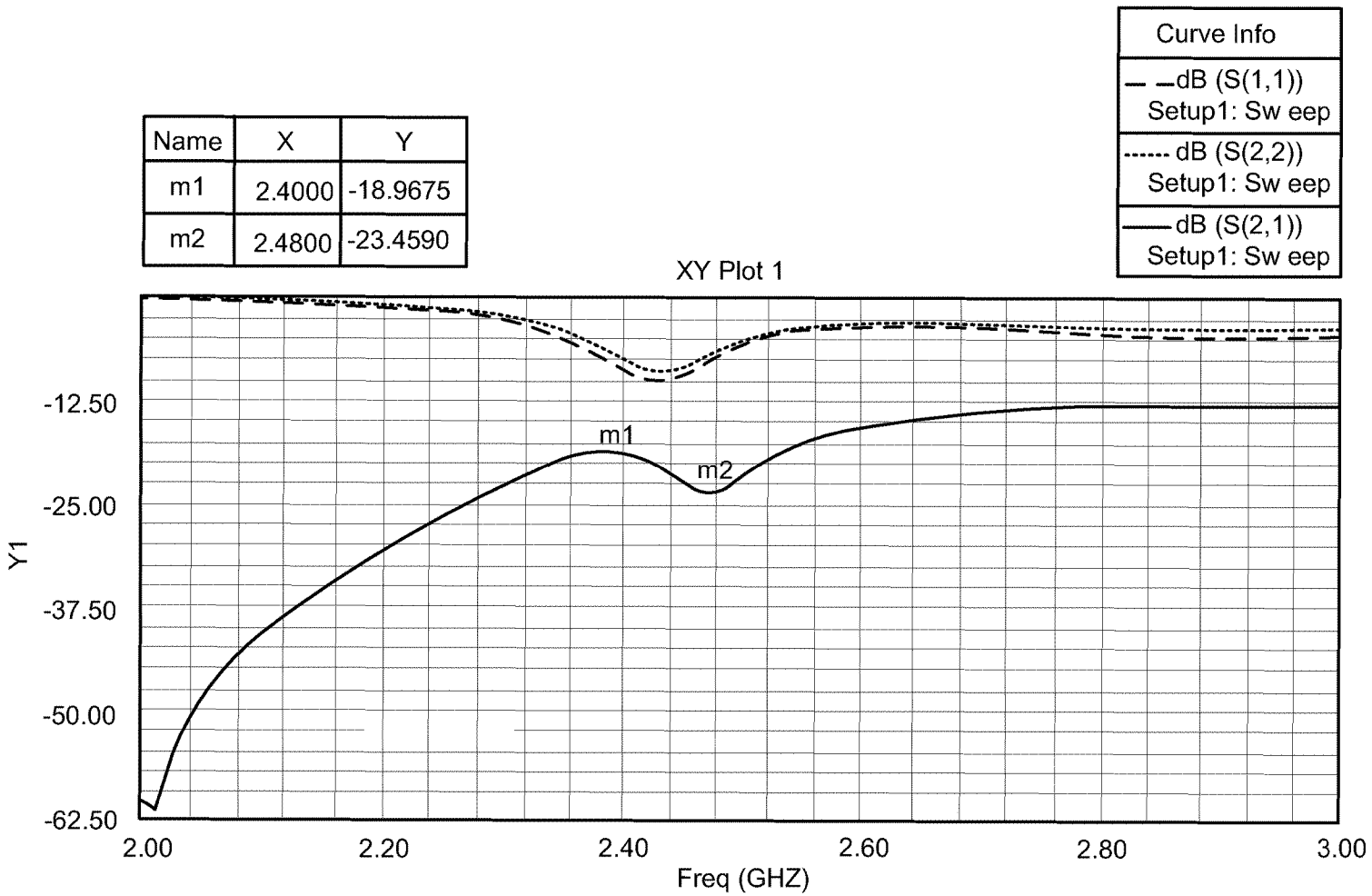
FIG. 9 shows return loss and isolation for the antennas shown in FIG. 8.

FIG. 8 shows a further embodiment of the present invention whereby short monopoles 17, 17' are used to drive resonant parasitic antennas 18, 18', with a tuned notch 9 provided between the antennas. FIG. 9 shows a plot of return loss and isolation for these antennas.

Figure 10:
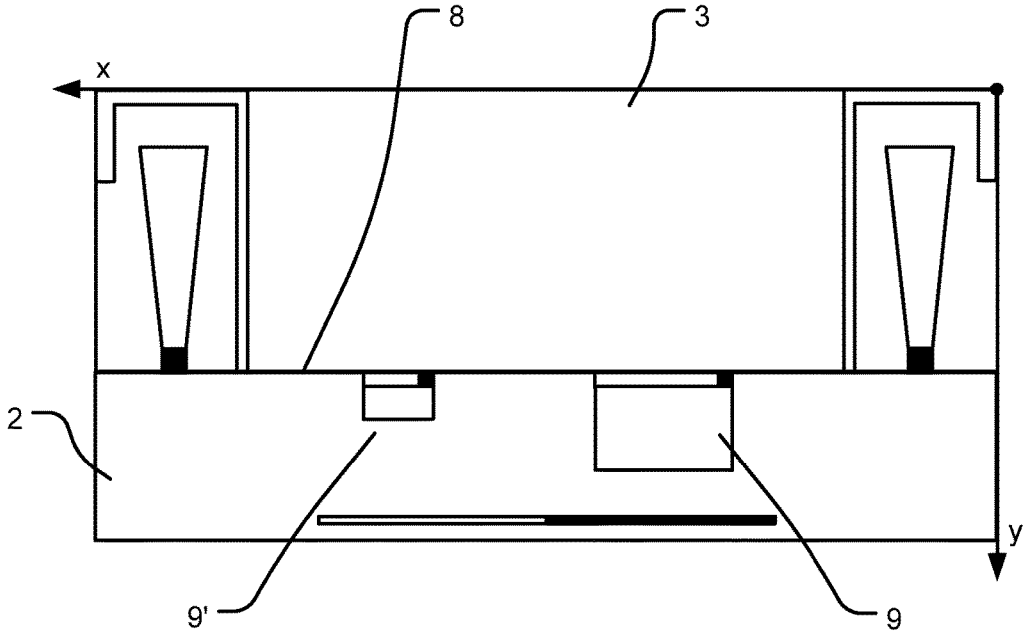
FIG. 10 shows an embodiment where two notches are tuned to different bandwidths.

In a further embodiment shown in FIG. 10, two notches or slots 9, 9' are provided in the edge 8 of the groundplane 2; the first notch 9 may be tuned to a lower band (the 2.4 GHz band for example) and a smaller second notch 9' may be tuned to a higher band (the 5 GHz band for example). Having two tuned slots or notches 9, 9' provides effective isolation for a low band and furthermore gives good isolation and antenna efficiency in the high band. It should be noted that the existence of two or more notches or slots also limits the minimum spacing between the antennas.

Figure 11:
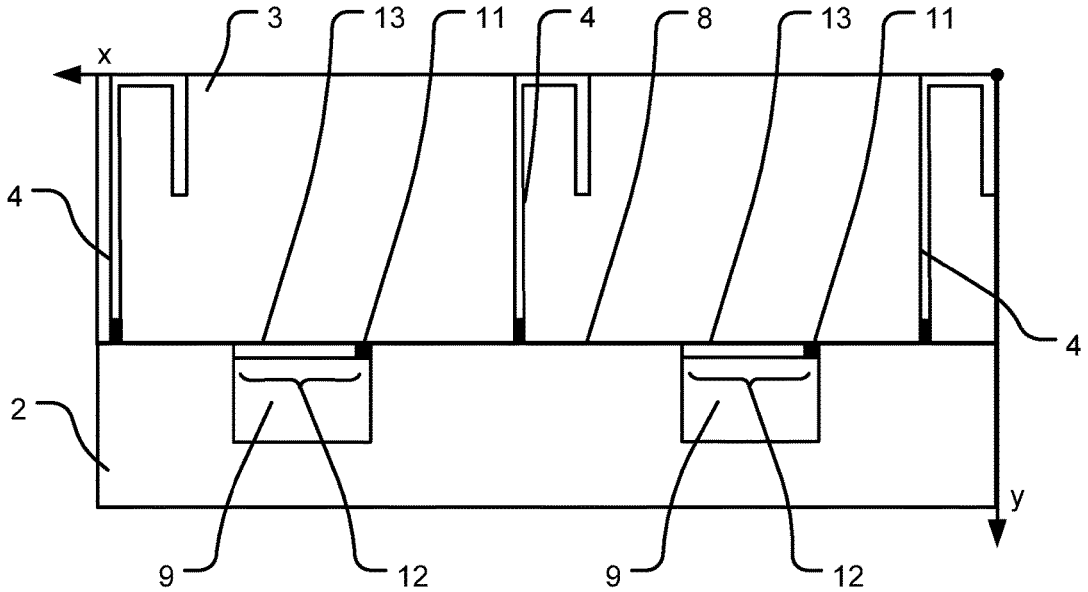
FIG. 11 shows a substantially linear array of antennas with a slot or notch between each pair of adjacent antennas.

FIG. 11 shows an arrangement comprising a substantially linear array of antennas 4 along the edge 8 of a groundplane 2 with a tuned notch 9 between adjacent antennas 4. This arrangement may comprise any suitable number of antennas 4 with interposed slots or notches 9.

Various antenna types may be used, including planar inverted F antennas, loop antennas, monopoles of all shapes, dielectric resonator antennas and dielectrically loaded antennas.

The antennas 4, 5 need not be parallel to each other. In another embodiment, two antennas are oriented at 90 degrees to each other, rather than being in parallel. This arrangement further improves isolation. Orientation angles other than 90 degrees may be employed.

Figure 12:
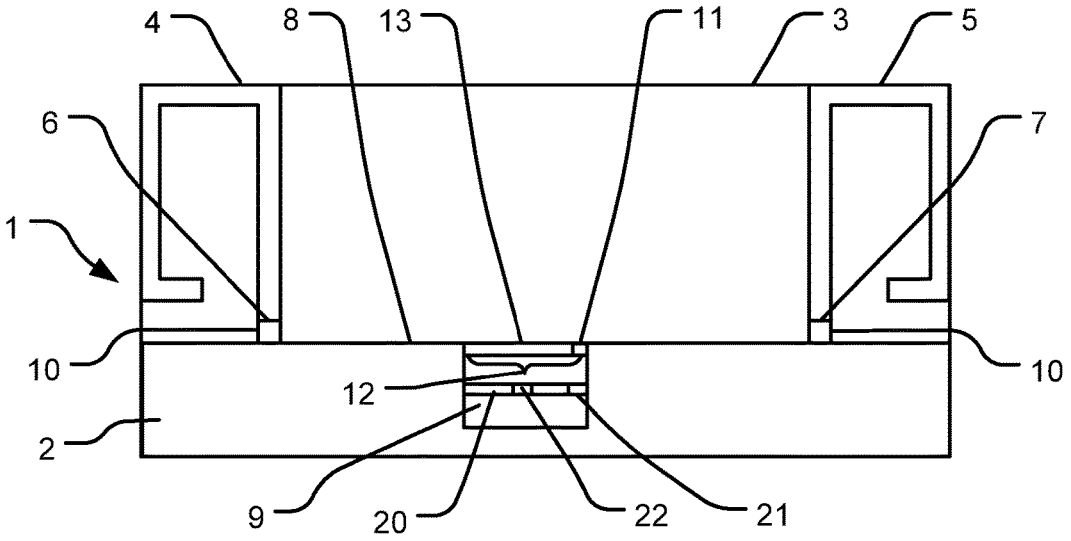
FIG. 12 shows an embodiment configured for dual band isolation.

FIG. 12 shows a further embodiment configured to allow antenna isolation in two bands. The general arrangement is the same as in FIG. 1, with like parts being labelled as for FIG. 1, including a conductive strip 13 in series with a capacitor 11. There is further provided a series resonant circuit in the form of an additional electrical pathway, which is a conductive strip 20 connecting one side edge of the notch 9 to the opposing side edge by way of a capacitor 21 and an inductor 22 in series with the capacitor 21. The additional pathway in the illustrated embodiment is generally parallel to the conductive strip 13 across the mouth 12 of the notch 9.

Figure 13:
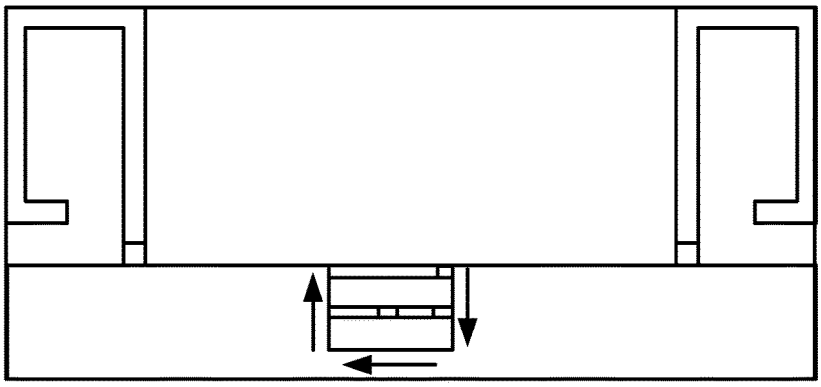
FIG. 13 shows a first current flow in the embodiment of FIG. 12.

When the first and second antennas 4, 5 are interacting at a frequency that is not at the center frequency of the resonant series circuit 20, 21, 22, the resonant series circuit will present a high impedance and the current induced by the antennas will flow along the edge of the notch 9 as shown in FIG. 13. A first frequency can be isolated by this mechanism by the at least one capacitive component 11 provided across the mouth of the notch 9.

Figure 14:
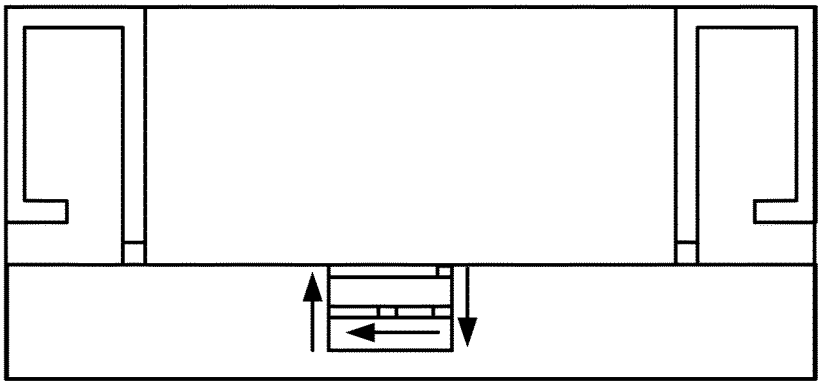
FIG. 14 shows a second current flow in the embodiment of FIG. 12.

When the first and second antennas 4, 5 are interacting at a frequency that is at or close to the center frequency of the resonant series circuit 20, 21, 22, then the resonant series circuit will present a low impedance and the current induced by the antennas will flow along the additional pathway through the resonant series circuit 21, 22 as shown in FIG. 14. A second frequency can be isolated by the capacitor 11 working in combination with the resonant series circuit 21, 22 in the additional pathway (e.g., 20, 22, and 21).

Figure 15:
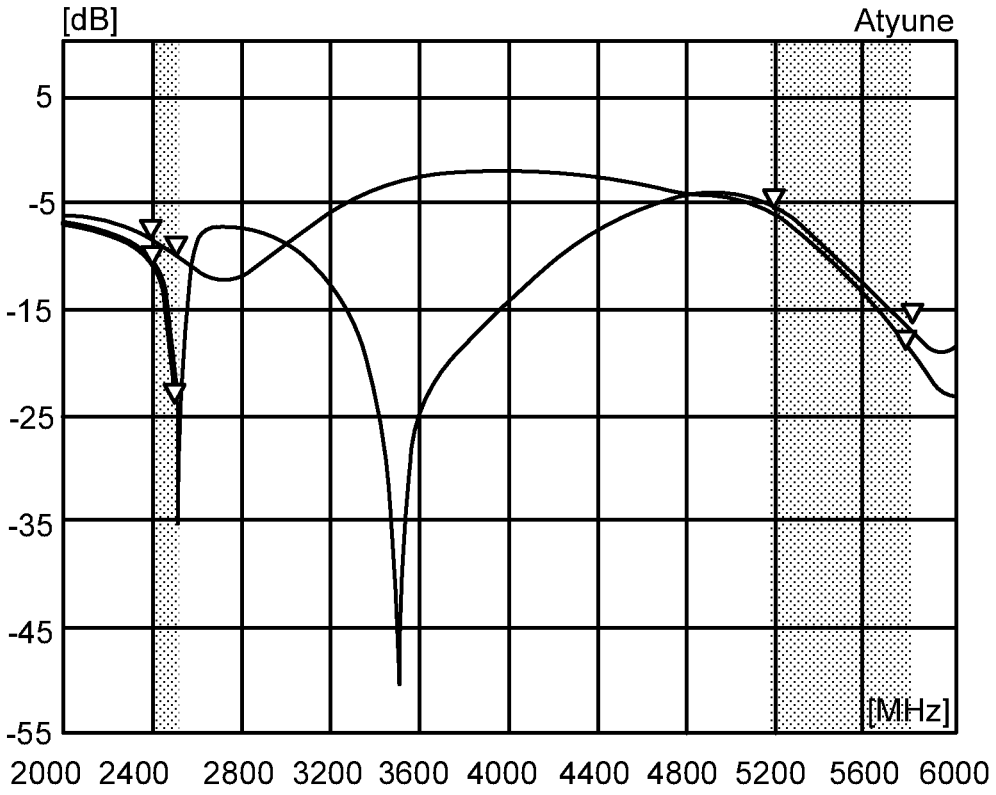
FIG. 15 shows a plot of antenna isolation for the embodiment of FIG. 1.

FIG. 15 shows a plot of antenna isolation against frequency for the arrangement of FIG. 1, compared to an arrangement where no isolation is provided. It can be seen that the tuning capacitor 11 has been configured to give improved isolation at around 2.4 GHz, with no substantial change in isolation in the 5 GHz.

Figure 16:
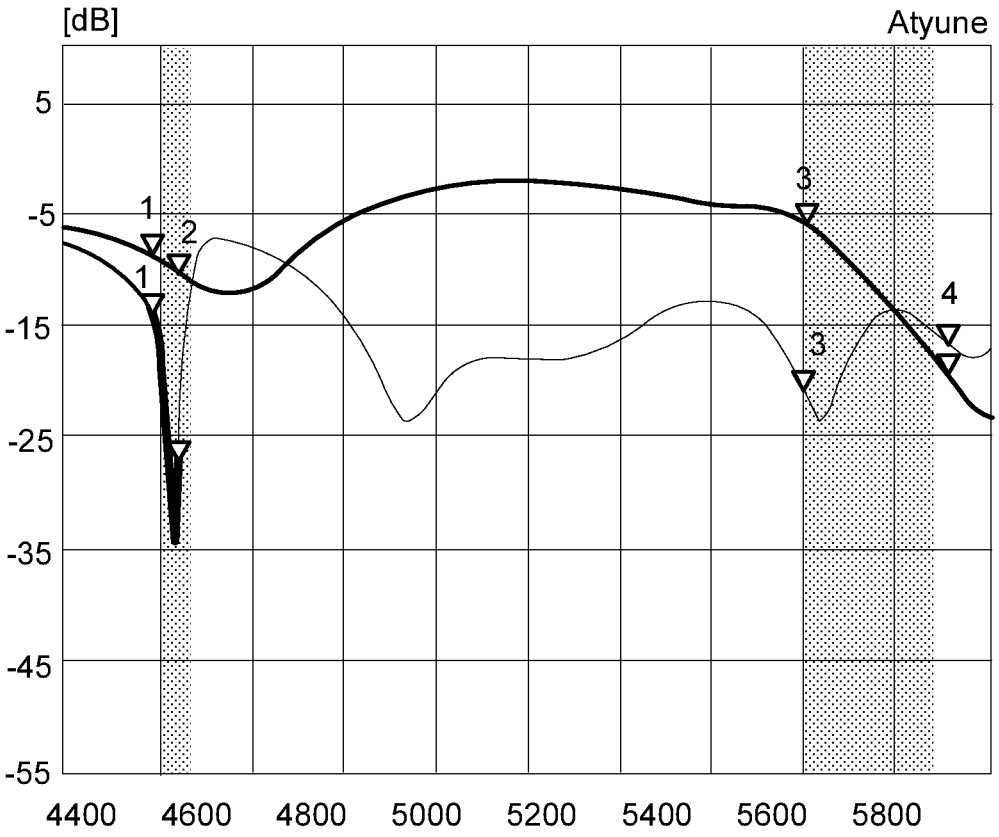
FIG. 16 shows a plot of antenna isolation for the embodiment of FIGS. 12 to 14.

FIG. 16 shows a plot of antenna isolation against frequency for the arrangement of FIGS. 12 to 14, compared to an arrangement where no isolation is provided. In addition to the improved isolation at 2.4 GHz due to capacitor 11, there is also improved isolation in the 5 GHz band due to the resonant series circuit 20, 21, 22.

Figure 17:
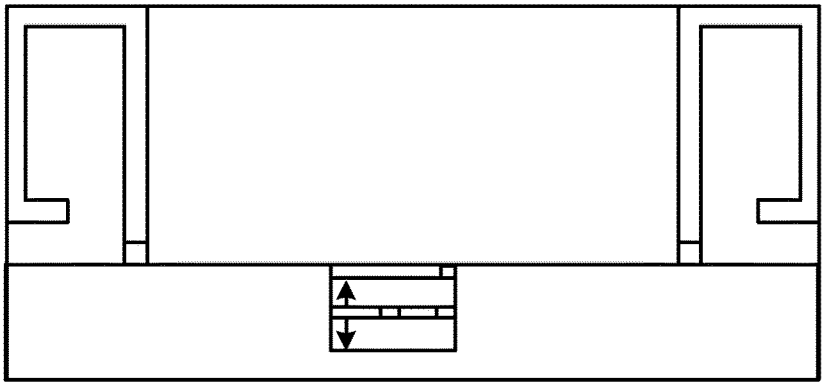
FIG. 17 shows how the additional pathway in the embodiment of FIG. 12 can be moved up and down.
Figure 18:
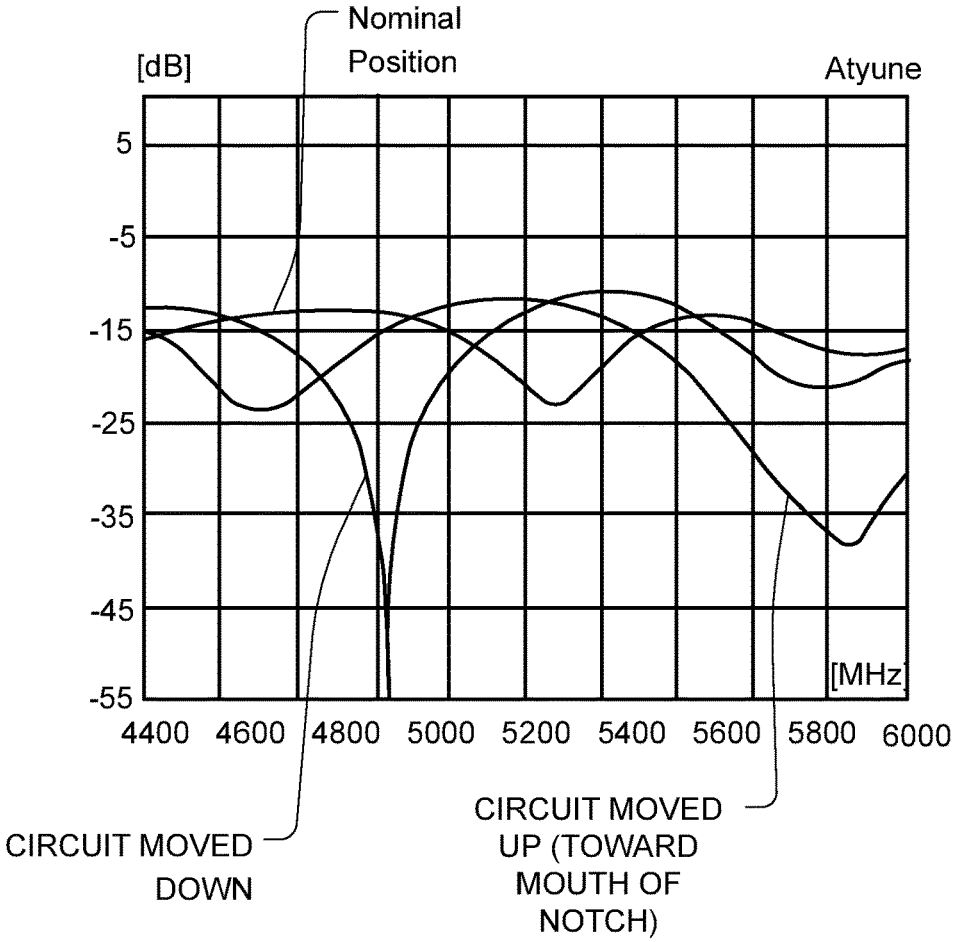
FIG. 18 shows the change of isolation obtained by the movement of the pathway shown in FIG. 17.

It is also possible to adjust the second isolation frequency by moving the additional pathway 2 closer to or further from the mouth 12 of the notch 9, as shown in FIG. 17. Moving the additional pathway (e.g., 20, 22, and 21) further away from the mouth 12 (closer to the bottom of the notch 9) will generally lower the isolation frequency, and this is demonstrated by FIG. 18.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

What is claimed:

1. A system comprising:

a conductive groundplane having a notch formed in an edge portion;

two antennas connected to the conductive groundplane and positioned on opposite sides of the notch;

a first electrical pathway connecting a first side edge of the notch to an opposite side edge and including a capacitive component along an edge of the notch to form a first resonant series circuit tuned to a first frequency of antenna operation, the first resonant series circuit tuned to provide isolation between the two antennas at the first frequency of antenna operation; and a second electrical pathway connecting the first side edge of the notch to the opposite side edge, the second electrical pathway including a second resonant series circuit providing isolation between the two antennas at a second different frequency of antenna operation, the first electrical pathway and the second electrical pathway concurrently connecting the first side edge of the notch to the opposite side edge of the notch while selectively providing the isolation at the first frequency and at the second different frequency.

2. The system of claim 1, wherein the second electrical pathway is within the notch between the first electrical pathway and a base of the notch.

3. The system of claim 2, wherein the second electrical pathway includes a capacitor in series with an inductor.

4. The system of claim 2, wherein the second electrical pathway is generally parallel to the first electrical pathway.

5. The system of claim 1, wherein the second electrical pathway provides low impedance when the two antennas are interacting at a frequency within a frequency band containing the center frequency of the second resonant series circuit.

6. The system of claim 1, wherein the second electrical pathway provides high impedance when the two antennas are interacting at a frequency outside a frequency band containing the center frequency of the second resonant series circuit.

7. The system of claim 1, wherein the first resonant circuit presents a lower impedance than the second resonant circuit when providing the isolation at the first frequency.

8. The system of claim 1, wherein the second resonant circuit presents a lower impedance than the first resonant circuit when providing the isolation at the second frequency.

9. The system of claim 1, wherein the first resonant series circuit is tuned to direct current at the first frequency of antenna operation through the notch to provide the isolation between the two antennas at the first frequency of antenna operation; and wherein the second resonant series circuit is tuned to direct current at the second frequency of antenna operation through the notch to provide the isolation between the two antennas at the second frequency of antenna operation.

10. A method comprising:

connecting two antennas to an edge portion of a conductive groundplane on opposite sides of a notch, the notch bridged by a first electrical pathway and a second electrical pathway, the first electrical pathway including a capacitive component along an edge of the notch to form a first resonant series circuit tuned to a first frequency of antenna operation, the first resonant series circuit providing isolation between the two antennas at the first frequency of antenna operation, and the second electrical pathway including a second resonant series circuit providing isolation between the two antennas at a second frequency of antenna operation, the first electrical pathway and the second electrical pathway concurrently bridging the notch while selectively providing the isolation at the first frequency and the second frequency.

11. The method of claim 10, wherein the second electrical pathway is disposed within the notch between the first electrical pathway and a base of the notch.

12. The method of claim 10, wherein the first electrical pathway is disposed across a mouth of the notch.

13. The method of claim 10, wherein the second electrical pathway is generally parallel to the first electrical pathway.

14. The method of claim 10, wherein the second resonant series circuit provides low impedance when the two antennas are interacting at a frequency within a frequency band containing a center frequency of the second resonant series circuit.

15. The method of claim 10, wherein the second resonant series circuit provides high impedance when the two antennas are interacting at a frequency outside a frequency band containing a center frequency of the second resonant series circuit.

16. The method of claim 10, wherein the first resonant series circuit is tuned to direct current at the first frequency of antenna operation through the notch to provide the isolation between the two antennas at the first frequency of antenna operation; and wherein the second resonant series circuit is tuned to direct current at the second frequency of antenna operation through the notch to provide the isolation between the two antennas at the second frequency of antenna operation.

17. An antenna device comprising:

a notch formed in an edge portion of a conductive groundplane;

two antennas connected to the edge portion of the conductive groundplane and positioned on opposite sides of the notch;

a first electrical pathway including a capacitive component along an edge of the notch to form a first resonant circuit tuned to a first frequency of antenna operation, the first resonant circuit providing isolation between the two antennas at the first frequency of antenna operation; and a second electrical pathway in parallel with the first electrical pathway and positioned between the first electrical pathway and a base of the notch, the second electrical pathway including a second resonant circuit providing isolation between the two antennas at a second different frequency of antenna operation, the first electrical pathway and the second electrical pathway concurrently connecting a first side edge of the notch to an opposite side edge while selectively providing the isolation at the first frequency and at the second different frequency.

18. The antenna device of claim 17, wherein the second resonant series circuit provides low impedance when the two antennas are interacting at a frequency within a frequency band containing a center frequency of the second resonant series circuit.

19. The antenna device of claim 17, wherein the second resonant series circuit provides high impedance when the two antennas are interacting at a frequency outside a frequency band containing a center frequency of the second resonant series circuit.

20. The antenna device of claim 17, wherein the first electrical pathway is a conductive strip including a capacitive component.

21. The antenna device of claim 17, wherein the second electrical pathway is a conductive strip connecting a first side edge of the notch to an opposite side edge by way of a capacitor in series with an inductor.

22. The antenna device of claim 17, wherein the first resonant series circuit is tuned to direct current at the first frequency of antenna operation through the notch to provide the isolation between the two antennas at the first frequency of antenna operation; and wherein the second resonant series circuit is tuned to direct current at the second frequency of antenna operation through the notch to provide the isolation between the two antennas at the second frequency of antenna operation.

* * * * *